US010223862B2

(12) United States Patent
Nordahl et al.

(10) Patent No.: US 10,223,862 B2
(45) Date of Patent: Mar. 5, 2019

(54) REMOTE GAMING SYSTEM

(75) Inventors: Mats Nordahl, Trångsund (SE); Jimmy Eiterjord, Västra Frölunda (SE)

(73) Assignee: TANGIAMO TOUCH TECHNOLOGY AB, Gothenburg (SE)

( * ) Notice: Subject to any disclaimer, the term of this patent is extended or adjusted under 35 U.S.C. 154(b) by 0 days.

(21) Appl. No.: 13/883,418

(22) PCT Filed: Nov. 30, 2011

(86) PCT No.: PCT/SE2011/051454
§ 371 (c)(1),
(2), (4) Date: Jun. 19, 2013

(87) PCT Pub. No.: WO2012/087221
PCT Pub. Date: Jun. 28, 2012

(65) Prior Publication Data

US 2014/0148251 A1 May 29, 2014

(30) Foreign Application Priority Data

Dec. 22, 2010 (EP) ..... 10196546

(51) Int. Cl.
*G07F 17/32* (2006.01)

(52) U.S. Cl.
CPC ..... *G07F 17/3225* (2013.01); *G07F 17/322* (2013.01); *G07F 17/323* (2013.01); *G07F 17/3206* (2013.01); *G07F 17/3211* (2013.01); *G07F 17/3218* (2013.01); *G07F 17/3272* (2013.01)

(58) Field of Classification Search
None
See application file for complete search history.

(56) References Cited

U.S. PATENT DOCUMENTS 5,588,650 A 12/1996 Eman et al.
2002/0090988 A1* 7/2002 Frost et al. ..... 463/17
(Continued)

FOREIGN PATENT DOCUMENTS

EP 0673004 A 9/1995
WO 2009032598 A 3/2009
WO 2009093065 A 7/2009

OTHER PUBLICATIONS

YouTube. (Mar. 25, 2008). PoquerBono.com poker Tutorial Part4_4 [Video file]. Retrieved from <URL:https://www.youtube.com/watch?v=M5LX-fAnFZY > (Note: screen shot is attached).*
(Continued)

*Primary Examiner* — Robert T Clarke, Jr.
(74) *Attorney, Agent, or Firm* — RMCK Law Group, PLC

(57) ABSTRACT

The present invention relates to a gaming system (100) comprising a local gaming device (101) and a first remote gaming device (108). If player of the respective devices (101/108) fulfills a predetermined gaming behavior criterion then gaming information is shared between common gaming interface portions of the respective devices (101/108). The invention provides an improved interaction between local (103) and remote players (107), resulting in a more realistic gaming experience for the local players as well as for the remote players. The invention also relates to a corresponding method, server, computer program product and remote gaming device.

15 Claims, 3 Drawing Sheets

(56) References Cited

U.S. PATENT DOCUMENTS

| | | | | |
|---|---|---|---|---|
| 2003/0232651 | A1 | 12/2003 | Huard et al. | |
| 2009/0093300 | A1* | 4/2009 | Lutnick et al. | 463/26 |
| 2010/0130280 | A1* | 5/2010 | Arezina | G07F 17/3206 463/20 |

OTHER PUBLICATIONS

PCT International Search Report dated Apr. 26, 2012 for International Application No. PCT/SE2011/051454, filed Nov. 30, 2011 (4 pages).

* cited by examiner

REMOTE GAMING SYSTEM

CROSS-REFERENCE TO RELATED APPLICATIONS

This application is a 371 U.S. National Stage of International Application No. PCT/SE2011/051454, filed Nov. 30, 2011, which claims priority to EPC No. 10196546.5, filed Dec. 22, 2010. The disclosure of each of the above applications is incorporated herein by reference in their entirety.

FIELD OF THE INVENTION

The present invention relates to a gaming system suitable for use in a gaming house environment, and more particularly to a gaming system where a game can be played by participants remotely as well as at the physical game site.

The invention also relates to a corresponding method, server, computer program product and remote gaming device.

BACKGROUND OF THE INVENTION

Gaming systems for use in a gaming environment, such as a casino, have a limited maximum number of participants able to play the game simultaneously due to, for example, the size of the specific gaming site or other physical limitations to the gaming system. There is also a disadvantage that a certain game might also be played at a specific location at the casino, and therefore the participant might have to find his way through the entire casino to locate the specific game he or she wants to play.

A solution to this problem is found in US 2003/232651, which provides a system for controlling and managing bets for a game played remotely from where the underlying live game is played. The system comprises an underlying game table, a camera, a plurality of player consoles and a game display. The game display acquires gaming information from the underlying game table by means of the camera. Participants playing the game remotely have a player console and follow the game by watching the game display. A game controller, connected to each remote player consoles, controls and manages bets and information from the different units. This solution gives the participants the opportunity to play the desired game at a remote location, and also provides a game suitable for a large plurality of participants.

However, the remote gaming system provided in US 2003/232651 does not provide a game in which the players, participating at a remote distance and participating at the physical gaming site, fully interact with each other. A player participating at the physical gaming site only interact with the other players at the physical gaming site, and not with the players participating at a remote distance from the physical gaming site.

SUMMARY OF THE INVENTION

Based on the above, an object of the present invention is thus to provide a system having improved interaction between players participating at a remote distance from a game site and players participating at the physical game site. The invention is based on the understanding that an improved interaction between local players and remote players will provide a more realistic gaming experience for the local players as well as for the remote players.

According to an aspect of the invention, these and other objects are achieved by a gaming system comprising a local gaming device comprising a processor and a display area, wherein the display area is configured to provide a gaming interface having a common gaming interface portion configured to allow interaction of at least one local player, a first remote gaming device comprising a processor and a display unit, wherein the display unit is configured to provide a gaming interface having a common gaming interface portion configured to allow interaction of a first remote player, wherein the first remote gaming device is communicatively coupled to the local gaming device over a network, and the common gaming interface portion provided on the display area of the local gaming device and the common gaming interface portion provided on the display unit of the first remote gaming device share gaming information if at least one of the local gaming device and the first remote gaming device determines, by means of at least one of its respective processors, that at least one of the local player and/or the first remote player fulfils a predetermined gaming behaviour criterion.

Advantages with the invention include for example the possibility for remote players to "participate" in a game at the physical game site, i.e. at the local gaming device, as well as at an "adjacent location" (e.g. in the same room) as the local gaming device. Hereby, the system allows for a large plurality of players to participate in the game simultaneously. In order to enable interaction between the local player and the first remote player, a predetermined gaming behaviour criterion determines whether the gaming information of the first remote player and/or the gaming information of the local player will be shared.

The local gaming device should, in the context of the present application, be understood to relate to a gaming device for any type of game played in a gaming environment, such as roulette, craps, baccarat, black jack, etc. The type of game played should not be limited for the use of the above mentioned system.

The criterion for sharing gaming information is based on the gaming behaviour of the player. Such a criterion may comprise a number of different criteria, such that for a player to share his gaming information, at least one of the predetermined gaming behaviour criteria must be fulfilled. The gaming behaviour for fulfilling the criterion may, for example, comprise the bet size carried out by the player, such that if the player bets a large amount at a game, the gaming information about the bet(s) will be shared. Another example of a gaming behaviour criterion may comprise the betting history of the player. For example, if the player is in a winning trend, i.e. is currently successful in his betting, that may fulfill the gaming behaviour criterion such that the gaming information is shared. The betting history may further comprise a predetermined number of bets executed by the player, such that if the player has participated in a game at a certain time. Furthermore, the predetermined gaming behaviour criterion may comprise the similarity of betting between the local player and the remote player. For example, in a specific game of baccarat the remote player may place his bet on the local player. Therefore, the gaming information of the local player may be shared with the remote player if they have similar gaming behaviour. This may of course be applied in the opposite way, i.e. that the local player places his bet on the remote player.

The predetermined gaming behaviour criteria may be different for the local player compared to the remote player, e.g. such that a higher activity level is required for the remote player, or vice versa. The gaming behaviour criterion may therefore be dependent on if the player is participating at the local gaming device or at a remote gaming device.

The gaming interface(s) described may contain a private gaming interface portion and a common gaming interface portion. The private gaming interface portion may only be available for the specific player. The private gaming interface portion may, for example, contain the players money account, cash balance, etc. On the other hand, the common gaming interface portion may contain, for example, the amount of betting executed by the player, the current bet, etc. In a roulette game, for example, the common gaming interface portion may contain the roulette wheel, the roulette layout and the current bets executed. If the local player and/or the first remote player fulfill the predetermined gaming behaviour criterion, the information of his common gaming interface portion may be shared. The amount of information shared may be controlled by the predetermined gaming behaviour criterion as well, i.e. more or less information may be shared depending on the gaming behaviour of the player.

The expression "local player" should be understood to mean a player of the game, who participates at the physical game site. "Remote player" should therefore be understood to mean a player who interacts with the local gaming device by participating from a distance of the game. This could for example be in a hotel room, at home or in other parts of the gaming environment. The specific location of the remote player is not limited to the scope of the present application.

The system according to the present invention may advantageously comprise a second remote gaming device comprising a processor and a display unit, wherein the display is configured to provide a gaming interface comprising a common gaming interface portion configured to allow interaction of a second remote player, wherein the second remote gaming device is communicatively coupled to at least one of the local gaming device and the first remote gaming device over a network, and the common gaming interface portion provided on the display unit of the first remote gaming device and the common gaming interface portion provided on the display unit of the second remote gaming device are configured to share gaming information if at least one of the local gaming device, the first remote gaming device and the second remote gaming device determines that at least one of the first and/or second remote player fulfils the predetermined gaming behaviour criterion.

If the remote player fulfils the predetermined gaming behaviour criterion, his gaming information may be shared to other remote players, as well as to the local player. Hence, the system may also comprise a "third remote gaming device", a "fourth remote gaming device", etc.

As above mentioned, the amount of gaming information shared between the players may vary depending on the specific predetermined gaming behaviour criterion. Also, the sharing of gaming information may not be mutual, i.e. a remote player who fulfils the predetermined gaming behaviour criterion may share information but may not receive gaming information from players who do not fulfill the predetermined gaming behaviour criterion. If the gaming information of all remote and local players would be available, it may be impossible for players to get a grip of other players gaming behaviour, thus reducing the interaction between the participants. This is especially the case if a large plurality of players simultaneously participating in the game.

The predetermined gaming behaviour criterion may also vary within the game, due to a dynamic activity level of the game. The dynamic activity level adjusts according to the gaming activity, such that a game with many participants having a high betting activity increases the activity level for sharing gaming information in relation to a game with few participants having a low betting activity. Furthermore, as mentioned above, the gaming behaviour criterion may be different for the local player compared to the remote player, such that a game with a large number of local players requires a higher activity level for a remote player to share gaming information in order to provide a maximum number of players sharing their gaming information.

In one embodiment of the present invention, a camera of the local gaming device acquires gaming information from the local gaming device to be provided to the remote gaming device. Furthermore, the display unit at the local gaming device acquires gaming information from the remote gaming device(s), if the remote player(s) fulfils at least one of the predetermined gaming behaviour criteria. Alternatively instead of using the display unit there may be provided a video projector for projecting the gaming information of the remote player(s) onto the common gaming interface at the local gaming device. In such a case for example in relation to the poker and/or roulette, the game cloth (e.g. poker or roulette cloth) may be adapted for receiving images from a video projector.

The camera may visually acquire the gaming activity at the local gaming device and provide the information to the remote players, and the display unit acquires gaming information from the common gaming interface portion of the remote player to the local gaming device, if the remote player fulfils at least one of the predetermined gaming behaviour criteria.

The local gaming device may alternatively comprise a multi-player touch screen. For example, in a roulette game, the roulette layout may comprise a multi-player touch screen, such that bets are executed by pressing the desired number on the roulette layout. This may not only reduce the need of gaming chips, but also provides a game where bets and pay-out can be carried out in a fast and efficient manner.

Additionally, the invention may further comprise means for acquiring gaming information from the remote gaming device comprising transmittal of commands, executed by the remote player, on the electronic multi-player touch gaming device. By providing means for acquiring gaming information from the remote player, who fulfils at least one of the predetermined gaming behaviour criteria, his bets will be visible to the local players in the same manner as the bets executed by the local players. Thus, an improved interaction between the players is provided, since the local players can follow the gaming behaviour of the remote player.

Furthermore, the remote gaming device may comprise a touch screen. Preferably, the touch screen is a multi-touch screen. The touch screen may allow the remote player to place his bet by pressing at the desired position on the touch screen of his remote gaming device, i.e. in a similar manner as placing a bet at the local gaming device. Hence, the interaction of the remote player is improved as he will have a similar gaming interface as standing at the physical game site.

Furthermore, the remote gaming device may be provided at the local gaming device. Thus, a local player may receive a remote gaming device at the local gaming device, comprising his private gaming interface portion as well as his common gaming interface portion, and seamlessly continue to play the game at a remote distance from the physical game site.

According to another aspect of the present invention, there is provided a method for operating a gaming system. This aspect provides similar advantages as discussed above.

According to still another aspect, there is provided a server for a gaming system. Also this aspect provides similar advantages as discussed above.

The system may for example be located in the same location as the local gaming device, but may of course be configured to communicate with the local gaming device and thus be located elsewhere away from the local gaming device. Accordingly, the stream of information between the local gaming device and the remote gaming device may for example take place over a network connection such as the Internet.

Still further, according to an aspect there is provided a computer program product comprising a computer readable medium having stored thereon computer program means for causing a server to operate a gaming system as discussed above. Also this aspect provides similar advantages as discussed above.

The computer readable medium may be one of a removable nonvolatile random access memory, a hard disk drive, a floppy disk, a CD-ROM, a DVD-ROM, a USB memory, an SD memory card, or a similar computer readable medium known in the art.

According to still a further aspect, there is provided a remote gaming device for a gaming system, the gaming system further comprises a local gaming device having a gaming interface comprising a common gaming interface portion configured to allow interaction of at least one local player, and a server for operating the gaming system, wherein the remote gaming device comprises a gaming interface comprising a common gaming interface portion configured to allow interaction of a first remote player and the remote gaming device is further configured to provide gaming bets to the server, receive gaming information from the common gaming interface of the local gaming device, display the gaming information from the common gaming interface of the local gaming device if it is determined that a predetermined gaming behaviour criterion is fulfilled.

Advantageously, the remote gaming device is at least one of a mobile phone, a PDA, a laptop and a tablet computer.

Other objectives, features, and advantages of the present invention will appear from the following detailed disclosure, from the attached dependent claims as well as from the drawings.

BRIEF DESCRIPTION OF THE DRAWINGS

These and other aspects of the present invention will now be described in more detail, with reference to the appended drawings showing at least one example embodiment of the invention, wherein.

DETAILED DESCRIPTION OF PREFERRED EMBODIMENTS

Figure 1:
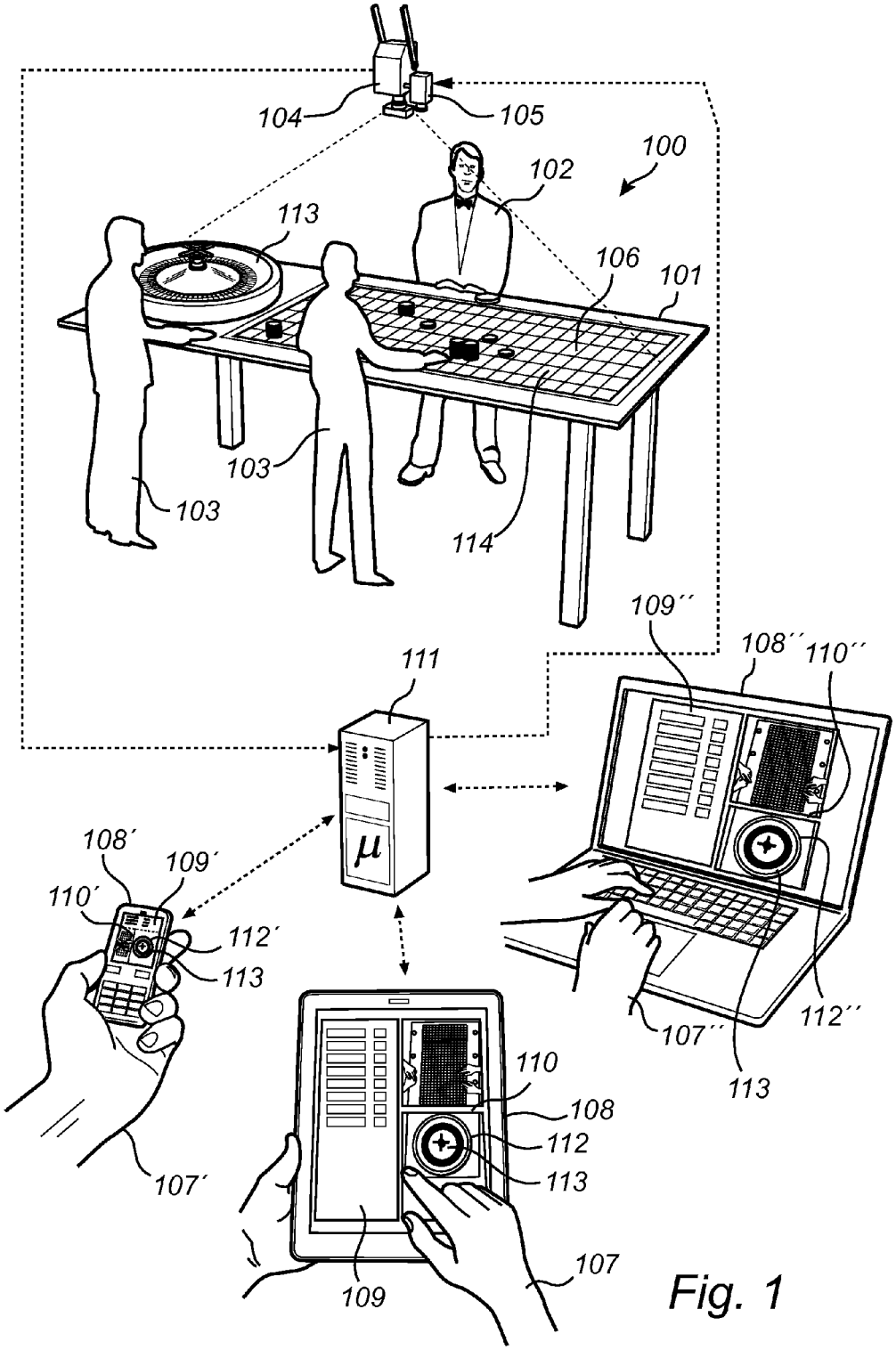
FIG. 1 schematically illustrates a gaming system according to a currently preferred embodiment of the invention comprising a local gaming device and a plurality of different remote gaming devices.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

In the following description, the present invention is described with reference to a gaming system 100 for playing a game located in a gaming house environment. The game can be played at the physical game site as well as at a location situated at a remote distance from the physical game site. Furthermore, the players, participating at the local game site and the players participating remotely from the physical game site, interact with each other based on a predetermined gaming behaviour criterion.

It should be noted that this by no means limits the scope of the present invention, which is equally applicable for a game located elsewhere, such as in a private house, at a hotel etc.

FIG. 1 illustrates a schematic view of a gaming system 100, where a local gaming device 101 having a display area is situated in a gaming house environment. The local gaming device 101 illustrated in this embodiment is a generic gaming table 114 having a croupier 102 and a number of local players 103 playing the game. The players 103 place their bet by use of gaming chips, cards or the like, depending on the specific game played and the croupier 102 collect and distribute the gaming chips or cards accordingly. The maximum number of local players 103 able to play the game simultaneously is determined by, for example, the size of the table and the number of seats around the table.

At the local gaming device 101, a camera 104 and a projector 105 are provided. The camera 104 is arranged such that it acquires at least a part of the local gaming device 101 and the projector 105 is arranged such that it can illuminate the gaming layout 106 of the local gaming device 101.

The gaming layout 106 of the generic gaming table 114 illustrated in FIG. 1, i.e. the layout (display area) where bets are executed, comprises a screen/cloth having a material susceptible for illumination of the projector.

Additionally, a number of remote players 107, 107', 107" can participate at the game from a position located at a distance from the local gaming device 101, such as at home, in a hotel room, in another part of the gaming house, etc. The remote players 107, 107', 107" each have a remote gaming device 108, 108', 108" comprising a processor and a display unit having a private gaming interface portion 109, 109', 109" and a common gaming interface portion 110, 110', 110". The private gaming interface portion 109, 109', 109" may only be available for the specific player and may, for example, contain the players money account, cash balance, etc. On the other hand, the common gaming interface portion 110, 110', 110" may contain, for example, the amount of betting executed by the player, the current bet, the gaming layout interface etc. To be able to participate in the game, the remote players 107, 107', 107" place their bets on the common gaming interface portion 110, 110', 110" of their remote gaming device 107, 107', 107".

Figure 4:
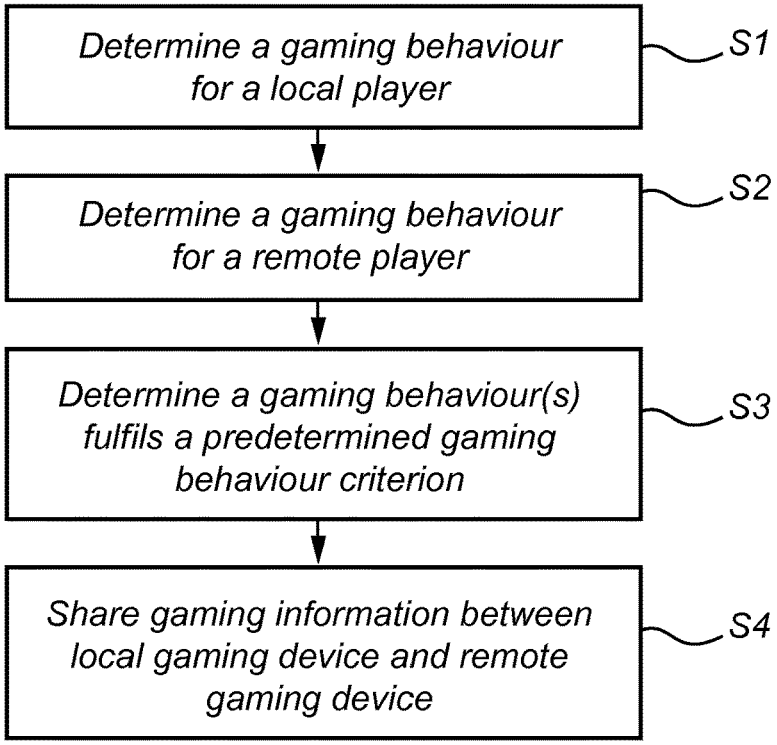

Furthermore and with reference to FIG. 1 in conjunction with FIG. 4, a server 111 is connected to the local gaming device 101. The server 111 receives the gaming activity of the local gaming device 101 from the camera 104 for determining, S1, a gaming behaviour for the at least one local player 103. Additionally, the server 111 also receives the gaming activity of the remote player(s), i.e. the bets executed on the common gaming interface portion 110, 110', 110" of the remote gaming device, for each remote player 107, 107', 107" for the purpose of determining, S2, a gaming behaviour for the first remote player.

The server 111 is further configured to select a number of bets, executed by the local players 103 and the remote players 107, 107', 107", that fulfils a predetermined gaming behaviour criterion, S3. Thereafter, the server 111 sends the bet(s) of the selected remote player(s) to the projector 105. The projector 105 illuminates the bets, executed by the selected remote player/players, on the gaming layout 106 of the local gaming device 101. Hereby, local players 103 interact with the selected remote players as their bets are visually illustrated among the bets executed by the local players 103, i.e. gaming information is shared, S4, between the local players 103 and the remote players 107, 107', 107".

Furthermore, the server 111 may also be configured to filter the bets executed by the local players 103 before sending the gaming activity to the different remote gaming devices 108, 108', 108". Hence, the remote players 107, 107', 107" may only interact with selected local players and/or selected remote players.

The predetermined gaming behaviour criterion may contain a number of criteria. Dependent on, for example, the specific game played or the number of local- or remote players participating in the game, the predetermined gaming behaviour may vary. For example, in a specific game of baccarat, a player may place his bet on another player. Therefore, a criterion for sharing gaming information in such a game of baccarat may comprise the similarity of betting activity between players, such that a player may share his gaming information to other players historically placing their bets in a similar way.

Another example of a gaming behaviour criterion may comprise the highest betting activity, such that the player placing the highest bet shares his gaming information. Furthermore, a player who is in a winning trend may share his gaming information for a predetermined number of continuing bets.

Yet another example of a predetermined gaming behaviour criterion may be if a number of friends participates the game, these friends may share gaming information in order to enable interaction between each other for example based on being friends through a social network such as e.g. Facebook. In such a case the login information used for the social network may e.g. be used for identifying the remote player(s) for each other. A still further example of a predetermined gaming behaviour criterion may comprise the location of the player; such that a player located adjacently to the local gaming device automatically fulfils the predetermined gaming criterion.

Figure 2:
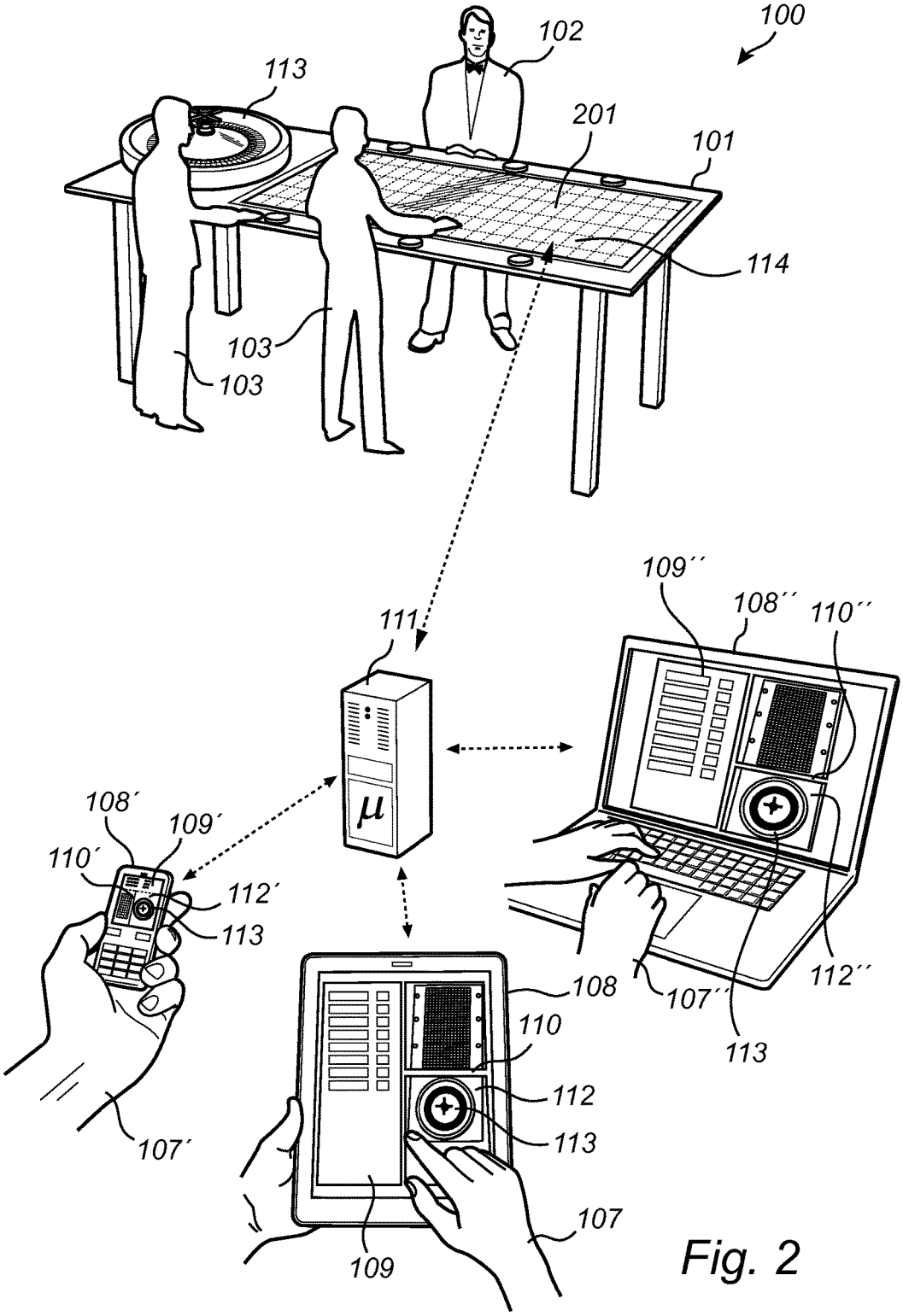
FIG. 2 shows an alternative gaming system comprising local gaming device having a multi-touch gaming interface.

An embodiment of the local gaming device is illustrated in FIG. 2, where the generic local gaming device 101 in FIG. 1 is replaced by a local gaming device 101 comprising an electronic multi-player touch screen 201. Local players 103 participates the game at the local gaming device 101 and the croupier 102 as well as the local players 103 may, by pressing at a desired number, card or the like, select his choice of action. Hereby, the need of gaming chips, card, dices or the like is reduced.

For example, in a game of craps, the participants may select the number they intend to bet on by pressing on that specific number, and instead of rolling a physical dice on the table, the dice may be rolled by executing a specific motion on the multi-player touch screen, which simulates the rolling of the dice.

The electronic gaming device may also allow participants to deposit their money to a private banking account which they, at the electronic gaming device, control. Hereby, the handling of money is reduced and the distribution of winnings is handled automatically. Furthermore, the use of an electronic multi-player touch screen 201 eliminates the need of a camera 104 and a projector 105 as discussed above.

In the same manner as described for the embodiment of FIG. 1, the server 111 receives the gaming information from the local gaming device 101 as well as from each of the remote gaming devices 108, 108', 108". The server 111 selects a number of bets, executed by the local players 103 and the remote players 107, 107', 107", that fulfils at least one of the predetermined gaming behaviour criteria. Thereafter, the server 111 sends the gaming information of the selected remote player/players to the local gaming device 101, where those bets are marked on the multi-player touch screen 201 in the same manner as the bets executed by the local players 103, thus interacting the local players 103 with the selected remote player/players.

The server 111 also sends the gaming information of the selected local players and/or the selected remote players to each of the remote gaming devices 108, 108', 108" participating in the game. The server 111 may send different gaming information to each of the remote gaming devices 108, 108', 108" depending on the predetermined gaming behaviour criteria. For example, one remote player 107 may receive the gaming information of all the local players 103 participating in the game, but another remote player 107' may only receive the gaming information from other remote players 107, 107".

Referring to the embodiment of FIG. 1 as well as FIG. 2, the common gaming interface portion 110, 110', 110" of the remote gaming device 108, 108', 108" comprises a gaming interface similar to the local gaming device 101, such that the local gaming device 101 is illustrated on the remote gaming device 108, 108', 108". Hereby, the remote player 107, 107', 107" may visually see his bet among the plurality of bets executed by the selected players and thus interact in the game.

In the exemplary embodiment of roulette and with reference to the embodiment of FIGS. 1 and 2, the user interface of the remote device(s) may comprise a section 112 where the spinning roulette wheel 113 is provided. The spinning roulette wheel 113 may be a real time video feed of the roulette wheel 113 present at the local gaming device 101, but may due to regulations alternatively be represented by any type of combination of live and virtually created video feeds fulfilling the requirements. As an example, in some cases the regulations restricts from providing a live video feed of a roulette wheel outside of the casino environment.

The remote gaming device 108, 108', 108" may comprise a cellular phone, a laptop computer, a stationary computer, a tablet computer, etc, and the remote gaming device 108, 108', 108" may, for example, communicate with the local gaming device 101 wirelessly or with other suitable means.

Furthermore, according to FIG. 1 and FIG. 2, the local gaming device 101 may provide remote gaming devices 108, 108', 108", such that a player who does not get a seat at the local gaming device 101 may be provided with a remote gaming device 108, 108', 108" from the croupier 102 in order to participate remotely. Also, a local player 103 intending to leave the table may receive a remote gaming device 108, 108', 108", comprising his common gaming interface portion 110, 110', 110" as well as his private gaming interface portion 109, 109', 109", such that he may seamlessly continue to participate in the game from a position located at a distance from the local gaming device 101.

Figure 3:
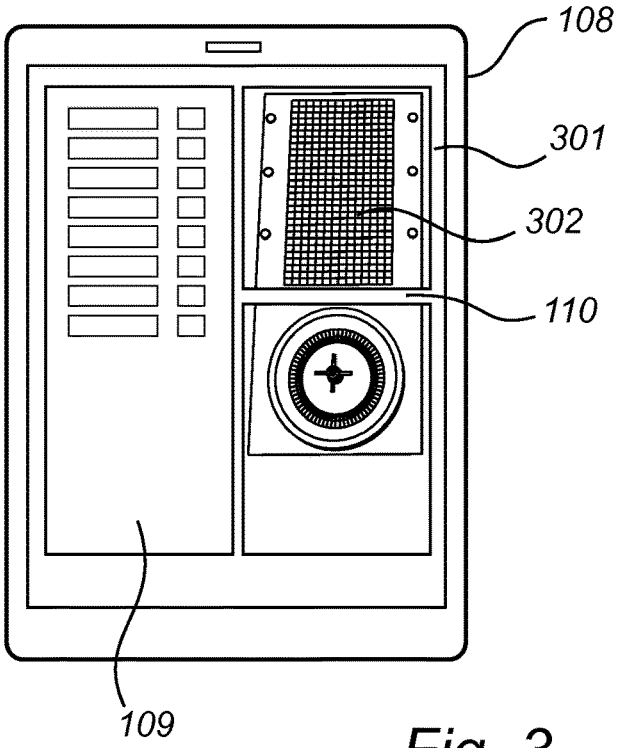
FIG. 3 illustrates the GUI of a remote gaming device, and FIG. 4 provides a flowchart of an embodiment of the method for operating a gaming system.

Referring now to FIG. 3, where an exemplary embodiment of a remote gaming device 108 is illustrated. The remote gaming device 108 in this embodiment comprises a touch-screen 301 having a private gaming interface portion 109 and a common gaming interface portion 110.

The private gaming interface portion 109 is only available to the remote player and includes, for example, his cash balance, money account etc. On the other hand, the common gaming interface portion 110 may comprise the gaming layout interface 302, the betting executed by the player, the current bets etc. The remote player share, when fulfilling at least one of the predetermined gaming behaviour criteria, his common gaming interface portion 110 to other participants of the game.

A remote gaming device 108 comprising a touch-screen 301 enables the remote player to place his bet by pressing at the desired number, card or the like. Hence, the procedure of placing bets on the remote gaming device may be similar to placing a bet at the local gaming device 101 illustrated in FIG. 2, thus improving the interaction of the game to the remote player.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage.

The invention has mainly been described above with reference to a few embodiments. However, as is readily appreciated by a person skilled in the art, other embodiments than the ones disclosed above are equally possible within the scope of the invention, as defined by the appended patent claims. For example, there may be other predetermined gaming behaviour criteria, depending on the specific game played. As an example, in a game of craps, the player rolling the dice may directly fulfill the predetermined gaming criterion such that due to the fact that he is the active player. Additionally, as is noted, the determination of the gaming criteria may be made using a distributed approach, e.g. by means of a processor comprised with the server, local device, or any of the remote devices.

The invention claimed is:

1. A gaming system comprising:

a server computing device comprising at least one processor configured to coordinate sharing of gaming information between a plurality of players participating in a game, each of the plurality of players placing a bet in the game via a respective gaming device;

a local gaming device comprising a first processor, a physical roulette wheel, and a multi-player touch screen having a display area, wherein the display area is configured to provide a first gaming interface having a first common gaming interface portion configured to allow interactions from at least one local player of the plurality of players that is participating in the game;

a first remote gaming device comprising a second processor and a first display, wherein the first display is configured to provide a second gaming interface comprising a second common gaming interface portion configured to allow interaction from a first remote player of the plurality of players that is participating in the game; and a second remote gaming device comprising a third processor and a second display, wherein the second display is configured to provide a third gaming interface comprising a third common gaming interface portion configured to allow interaction of a second remote player, wherein the first remote gaming device, the second remote gaming device, the local gaming device, and the server computing device are communicatively coupled over a network, wherein the server computing device determines which of the bets to share between the local gaming device, the first remote gaming device, and the second remote gaming device based on a predetermined gaming behavior criterion such that a particular bet of a particular player is: (i) shared with one of the local gaming device, the first remote gaming device, and the second remote gaming device when the server computing device determines that the particular player has fulfilled the predetermined gaming behavior criterion during the game, and (ii) not shared with one of the local gaming device, the first remote gaming device, and the second remote gaming device when the particular player has not fulfilled the predetermined gaming behavior criterion during the game, wherein, when the first remote player fulfills the predetermined gaming behavior criterion and places a first bet at the first remote gaming device, the first bet is shared with at least one of the local gaming device and the second remote gaming device, wherein, when the second remote player fails to fulfill the predetermined gaming behavior criterion and places a second bet at the second remote gaming device, the second bet is not shared with the local gaming device and the second remote gaming device, wherein, when the particular bet is shared with the local gaming device, the particular bet is marked on the multi-player touch screen in a same manner as a bet executed by said local player, wherein the local gaming device further comprises a camera that acquires video of the physical roulette wheel during the game to be provided to the first and second remote gaming devices, and wherein the predetermined gaming behavior criterion comprises at least one of:

a geographical relation between the particular player and the other players;

a highest betting activity; and a similarity of betting activity between the particular player and the other players.

2. The gaming system of claim 1, wherein the predetermined gaming behavior criterion of the particular player is based on whether the particular player is participating in the game via the local gaming device or the first or second remote gaming devices.

3. The gaming system of claim 1, wherein the predetermined gaming behavior criterion varies based on a dynamic activity level of the game that adjusts according to gaming activity.

4. The gaming system of claim 3, wherein a high level of gaming activity results in the predetermined gaming behavior criterion being more difficult to satisfy.

5. The gaming system of claim 1, wherein the at least one local player utilizes the multi-player touch screen to place a local bet.

6. A method for operating a gaming system, wherein the gaming system comprises:

a server computing device comprising at least one processor configured to coordinate sharing of gaming information between a plurality of players participating in a game, each of the plurality of players placing a bet in the game via a respective gaming device;

a local gaming device comprising a first processor, a physical roulette wheel, and a multi-player touch screen having a display area, wherein the display area is configured to provide a first gaming interface having a first common gaming interface portion configured to allow interactions from at least one local player of the plurality of players that is participating in the game;

a first remote gaming device comprising a second processor and a first display, wherein the first display is configured to provide a second gaming interface comprising a second common gaming interface portion configured to allow interaction from a first remote player of the plurality of players that is participating in the game; and a second remote gaming device comprising a third processor and a second display, wherein the second display is configured to provide a third gaming interface comprising a third common gaming interface portion configured to allow interaction of a second remote player, wherein the first remote gaming device, the second remote gaming device, the local gaming device, and the server computing device are communicatively coupled over a network, wherein the method comprises:

determining gaming behavior during the game for a particular player of the plurality of players;

determining whether the gaming behavior of the particular player fulfills a predetermined gaming behavior criterion; and determining which of the bets to share between the local gaming device, the first remote gaming device, and the second remote gaming device based on the predetermined gaming behavior criterion such that a particular bet of the particular player is: (i) shared with one of the local gaming, the first remote gaming device, and the second remote gaming device when the server computing device determines that the particular player has fulfilled the predetermined gaming behavior criterion during the game, and (ii) not shared with one of the local gaming device, the first remote gaming device, and the second remote gaming device when the particular player has not fulfilled the predetermined gaming behavior criterion during the game, wherein, when the first remote player fulfills the predetermined gaming behavior criterion and places a first bet at the first remote gaming device, the first bet is shared with at least one of the local gaming device and the second remote gaming device, wherein, when the second remote player fails to fulfill the predetermined gaming behavior criterion and places a second bet at the second remote gaming device, the second bet is not shared with the local gaming device and the second remote gaming device, wherein, when the particular bet is shared with the local gaming device, the particular bet is marked on the multi-player touch screen in a same manner as a bet executed by said local player, wherein the local gaming device further comprises a camera that acquires video of the physical roulette wheel during the game to be provided to the first and second remote gaming devices, and wherein the predetermined gaming behavior criterion comprises at least one of:

a geographical relation between the particular player and the other players;

a highest betting activity; and a similarity of betting activity between the particular player and the other players.

7. The method of claim 6, wherein the predetermined gaming behavior criterion of the particular player is based on whether the particular player is participating in the game via the local gaming device or the first or second remote gaming devices.

8. The method of claim 6, wherein the predetermined gaming behavior criterion varies based on a dynamic activity level of the game that adjusts according to gaming activity.

9. The method of claim 8, wherein a high level of gaming activity results in the predetermined gaming behavior criterion being more difficult to satisfy.

10. The method of claim 6, wherein the at least one local player utilizes the multi-player touch screen to place a local bet.

11. A server computing device for a gaming system, wherein the gaming system comprises:

the server computing device;

a local gaming device comprising a first processor, a physical roulette wheel, and a multi-player touch screen having a display area, wherein the display area is configured to provide a first gaming interface having a first common gaming interface portion configured to allow interactions from at least one local player of a plurality of players that is participating in a game;

a first remote gaming device comprising a second processor and a first display, wherein the first display is configured to provide a second gaming interface comprising a second common gaming interface portion configured to allow interaction from a first remote player of the plurality of players that is participating in the game; and a second remote gaming device comprising a third processor and a second display, wherein the second display is configured to provide a third gaming interface comprising a third common gaming interface portion configured to allow interaction of a second remote player, wherein the first remote gaming device, the second remote gaming device, the local gaming device, and the server computing device are communicatively coupled over a network, the server computing device comprising:

at least one processor configured to coordinate sharing of gaming information between the plurality of players participating in the game, each of the plurality of players placing a bet in the game via a respective gaming device, wherein the server computing device determines which of the bets to share between the local gaming device, the first remote gaming device, and the first second remote gaming device based on a predetermined gaming behavior criterion such that a particular bet of a particular player is: (i) shared with one of the local gaming device, the first remote gaming device, and the second remote gaming device when the server computing device determines that the particular player has fulfilled the predetermined gaming behavior criterion during the game, and (ii) not shared with one of the local gaming device, the first remote gaming device, and the second remote gaming device when the particular player has not fulfilled the predetermined gaming behavior criterion during the game, wherein, when the first remote player fulfills the predetermined gaming behavior criterion and places a first bet at the first remote gaming device, the first bet is shared with at least one of the local gaming device and the second remote gaming device, wherein, when the second remote player fails to fulfill the predetermined gaming behavior criterion and places a second bet at the second remote gaming device, the second bet is not shared with the local gaming device and the second remote gaming device, wherein, when the particular bet is shared with the local gaming device, the particular bet is marked on the multi-player touch screen in a same manner as a bet executed by said local player, wherein the local gaming device further comprises a camera that acquires video of the physical roulette wheel during the game to be provided to the first and second remote gaming devices, and wherein the predetermined gaming behavior criterion comprises at least one of:

a geographical relation between the particular player and the other players;

a highest betting activity; and a similarity of betting activity between the particular player and the other players.

12. The server computing device of claim 11, wherein the predetermined gaming behavior criterion of the particular player is based on whether the particular player is participating in the game via the local gaming device or the first or second remote gaming devices.

13. The server computing device of claim 11, wherein the predetermined gaming behavior criterion varies based on a dynamic activity level of the game that adjusts according to gaming activity.

14. The server computing device of claim 13, wherein a high level of gaming activity results in the predetermined gaming behavior criterion being more difficult to satisfy.

15. The server computing device of claim 11, wherein the at least one local player utilizes the multi-player touch screen to place a local bet.

* * * * *